United States Patent [19]

Belanger, Jr.

[11] Patent Number: 4,894,258

[45] Date of Patent: Jan. 16, 1990

[54] CHIP RESISTOR

[75] Inventor: Thomas D. Belanger, Jr., Clarendon Hills, Ill.

[73] Assignee: AG Communication Systems Corporation, Phoenix, Ariz.

[21] Appl. No.: 294,443

[22] Filed: Jan. 9, 1989

Related U.S. Application Data

[63] Continuation-in-part of Ser. No. 171,321, Mar. 21, 1988, abandoned.

[51] Int. Cl.[4] ..... B05D 5/12

[52] U.S. Cl. ..... 427/103; 156/246; 156/247; 156/250; 264/61; 428/901; 427/282

[58] Field of Search ..... 264/61, 212, 213, 102; 156/246, 247, 250; 428/43, 901; 427/103, 282

[56] References Cited

U.S. PATENT DOCUMENTS

| | | | |
|---|---|---|---|
| 4,349,496 | 9/1982 | Levinson | 264/61 |
| 4,366,198 | 12/1982 | Ramspacher, Jr. | 428/901 |
| 4,370,288 | 1/1983 | Rice, Jr. et al. | 264/61 |
| 4,734,233 | 3/1985 | Toda et al. | 264/61 |

*Primary Examiner*—Stanley Silverman

*Attorney, Agent, or Firm*—Robert J. Black; Gregory G. Hendricks

[57] ABSTRACT

Thick film resistors are fabricated for use in hybrid microcircuits by a sequence of steps beginning with the formation of a dielectric substrate on a carrier substrate. The dielectric layer is then baked to provide an appropriate rigidity after which a resistance element is deposited thereon as well as conductive terminals, the subsequent firing of both materials followed by heating of the entire assembly to a point where the adhesive characteristics of the dielectric layer are substantially reduced and the resultant film resistors become separated from the carrier substrate.

9 Claims, 1 Drawing Sheet

CHIP RESISTOR

This application is a continuation-in-part of co-pending application Ser. No. 07/171,321 filed on Mar. 21, 1988 now abandoned.

BACKGROUND OF THE INVENTION

1. Field of the Invention

This invention relates to the fabrication of thick film resistors for use in hybrid microcircuits and more particularly, to a method of forming dielectric material on a substrate material during the fabrication of the thick film resistors and subsequent removal of the thick film resistors from the carrier substrate.

2. Description of the Related Art

Various techniques for the fabrication of thick film resistors have been proposed in the past. Thick film resistors have been in use in the electronics industry for more than the past 20 years. One typical application has been to use the thick film resistor in conjunction with a conductor network in a hybrid circuit. Recently, many users of such device have directed development activities toward the making and use of pick-and-place technology to fabricate the hybridized circuitry. The resistors currently being evaluated for most of these applications are typically cermet chip resistors. These resistors are in effect separate thick circuits consisting of one resistor terminated with a conductor. The structure of these resistors is like that illustrated in FIG. 2 of the prior art, and consists of an alumina substrate 23 on which is located a resistor coating 20, a first conductor such as 22 located in contact with the resistive material 20 and second edge mounted conductor 24 connected thereto and the resistive material 20 and first conductor 22 is covered by glass encapsulant 21. A comparison of this type of resistor to that of a typical thick film resistor, which consists of an alumina substrate 13 on which are formed conductors, such as conductor 12 in contact with resistive material 10 and with a glass encapsulant material 11 superimposed over the resistive material, as shown in FIG. 1, will show only the addition of the edge conductor 24. The prior art techniques exhibit a number of drawbacks, including high cost, the fabrication, difficulty in mounting and establishing appropriate electrical connections to the unit. Many of the techniques proposed require inefficient manual soldering operations for a connection, while others, in an attempt to accommodate dip soldering or reflow soldering techniques, use such uneconomical techniques as vacuum, electron beam evaporation or sputtering to achieve devices where a connection can be made by dip soldering or reflow soldering.

In yet another instance, films may be deposited by printing metal glaze paste or by similar means and then the films are fired to form lateral electrodes. The high temperature of the firing operation called for thus causes deterioration of the low resistance temperature coefficient of the resistor and the high stability of the resistives which characterize the resistor.

SUMMARY OF THE INVENTION

The present invention proposes a thick film chip resistor constructed of two layers: a carrier substrate and a ceramic adhesive (ceramic substrate) with the conductors superimposed either above or below the resistive material on top of the ceramic substrate. The particular technique and materials utilized in the present process of making chip resistors effectively takes advantage of that condition, wherein the ceramic adhesive material loses its adhesion to the metal substrate during the material processing cycle. Thus, the metal carrier substrate can be disposed of, leaving a resistor fabricated upon a ceramic substrate which readily adapts itself to the utilization in hybrid technology.

Thus, in view of the foregoing difficulties with the prior art, it is an object of the present invention to provide a chip resistor having a simplified manufacturing process which facilitates the pick-and-place technology used for the construction of hybrid conductive networks.

It is another object of the invention to provide a chip resistor having a thick film resistor which can be produced by a simple way without detriment to the adhesive characteristic of the thick film resistor.

It is still another object of the invention to provide a chip resistor which can easily be connected to a hybrid circuit unit by a simple mass-produced soldering techniques.

DETAILED DESCRIPTION OF THE INVENTION

Figure 1:
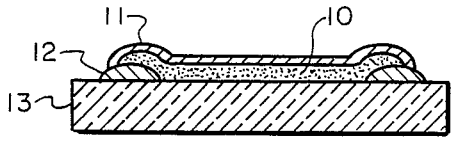
FIG. 1 (PRIOR ART)
FIG. 1 is a sectional view of a prior art thick film resistor viewed in cross-section as fabricated within a circuit.
Figure 2:
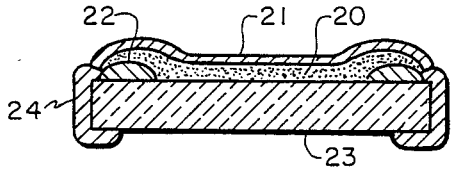
FIG. 2 (PRIOR ART)
FIG. 2 is a typical cross-section of a prior art chip resistor.
Figure 3:
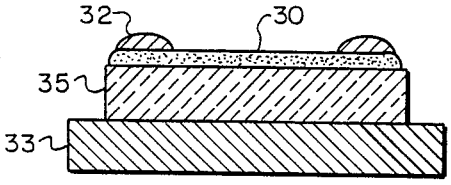
FIG. 3 is a cross-sectional view of a chip resistor in accordance with the present invention.

Referring now to FIG. 3, an alumina or other metallic substrate 33 is employed as a carrier or support device during construction of thick film resistors as taught in the present invention. Upon this carrier substrate, an adhesive layer 35 of a ceramic adhesive dielectric material, such as the No. 481 adhesive manufactured by the Sermetel Materials Division of Teleflex Incorporated is placed. This material is either brushed or screened on after which it is heated to a temperature of 315 degrees centigrade in an air atmosphere for a period of approximately one hour.

After this, the resistive material 30 may be applied to the dielectric material 35 which is now of sufficient thickness and rigidity after baking so that it will support the chip resistor. The resistive material 30 will now be applied to the ceramic substrate by screen-printing, spraying or any other well-known technique utilized by those skilled in the art. At the completion of the application of the resistive material, the resultant assembly will be heated for ten minutes at a temperature of approximately 150 degrees centigrade to eliminate any organic component present in the resistive material 30.

After this step is completed, conductors 32 may be applied by any of the similar techniques to those utilized for the application of the resistive material 30, after which heating for ten minutes, at approximately 150 degrees centigrade takes place to eliminate any organic component present in the conductive material 32. While it is preferred that the resistive materials 30 be processed prior to the conductive material 32, it is quite possible for the conductors 32 to be printed first, after which the resistive material 30 would be applied over the conductive material 32 with the appropriate heating steps included in between.

It should be noted that the temperatures at which the heating initially of the adhesive material 35 and the subsequent heating of the resistive 30 and conductive materials 32 takes place are substantially below 704 degrees centigrade, which is the temperature at which, when the ceramic dielectric 35 is fired, it will lose most of its adhesion quality to the supporting metallic carrier substrate 33. After the resistive material and the conductive material has been applied and heated, the entire assembly would be fired for approximately one hour in an air atmosphere at a temperature reaching 850 degrees centigrade for a period of ten minutes and then allowed to cool.

After this final firing step, the dielectric 35 loses most of its adhesion quality and the resistor is thus released from the carrier substrate 33 with the application of only minimum additional force. It should be then noted that during construction of at least one embodiment of the present invention, numerous screen printable or sprayable thick film resistor compositions may be used for the resistive portion 30, while numerous thick film conductive inks may be utilized for the conductor.

Figure 4:
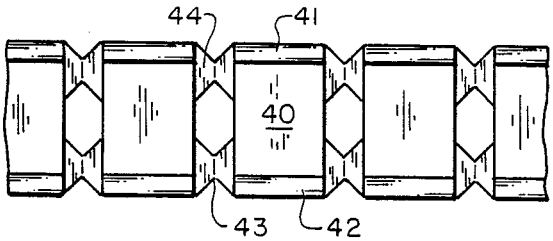
FIG. 4 is a top view of a plurality of resistors constructed in accordance with the methods set forth in the present invention.
Figure 5:
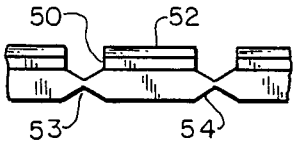
FIG. 5 is a side view of a plurality of resistors constructed in accordance with the methods set forth in the present invention.

Utilization of a dielectric adhesive 35 as a substrate material permits the printing of resistors of various sizes. Inasmuch as the resistors will at least partially selfrelease during the processing cycle. There is no need for the usual requirement of laser scribing to separate the resistors from the base material. It is also suggested that a bar of dielectric material 44 and 54 may be printed between individual resistors as shown in FIGS. 4 and 5 with fracture points designated at locations like 43, as shown in FIG. 4, and 53, as shown in FIG. 5.

An alternate option for use in the design of resistors in accordance with the present invention would be to incorporate the use of an organic conductive material to dip the edges of the resistors to allow for side terminations.

The concept of using an adhesive to adhere chip resistors to a carrier substrate during processing is not necessarily limited as in the present invention to the high temperature cermet materials. The concept may also be incorporated into the fabrication of chip resistors using organic materials where the dielectric may be a nonconductive epoxy.

While but a particular embodiment of the present invention has been shown, it will be obvious to those skilled in the art that numerous modifications of the present invention may be made without departing from the spirit of the present invention, which shall be limited only by the scope of the claims appended hereto.

What is claimed is:

1. A method for fabricating thick film resistor assemblies comprising the steps of:

applying a ceramic adhesive dielectric material to one side of a metallic carrier substrate so as to form a plurality of resistive units on said substrate, including fracture areas between any two adjacent resistive areas;

heating said ceramic adhesive-coated carrier substrate to cure said ceramic adhesive, whereby said adhesive becomes solid;

applying a coating of resistive material to said solidified ceramic adhesive dielectric material;

heating the resultant assembly to eliminate any organic component from said resistive material;

applying conductive material to form one or more conductors to said resistive material;

heating the resultant assembly to eliminate any organic component in said conductive material;

firing the total assembly to a temperature of at least 704 degrees centigrade for a period within the range of from 40 to 80 minutes with the temperature reaching its maximum range for a period within the range of 8 to 12 minutes centered about the midpoint of said firing period, to eliminate the adhesive characteristic of said ceramic material;

separating said carrier substrate from said assembly; and separating said resistive units by manually applying pressure at each of said fracture areas, whereby said resistive units are separated from each other.

2. The method for fabricating thick film resistive assemblies as claimed in claim 1, wherein:

said step of applying said resistive material and said step of applying said conductive material are reversed.

3. A method for fabricating thick film resistive assemblies as claimed in claim 1, wherein:

that heating of said carrier substrate and said ceramic adhesive dielectric material occurs in an air atmosphere at a temperature within the range of 300–330 degrees centigrade.

4. A method for fabricating thick film resistor assemblies as claimed in claim 1, wherein:

said application of resistive material to said ceramic adhesive dielectric material is done by a screening process.

5. A method for fabricating thick film resistor assemblies as claimed in claim 1, wherein:

said application of said conductive material to said resistive material is done by a screening process.

6. A method for fabricating thick film resistor assemblies as claimed in claim 1, wherein:

the heating of said resistive material occurs at a temperature within the range of 140–160 degrees centigrade.

7. A method for fabricating thick film resistor assemblies as claimed in claim 1, wherein:

the heating of said conductors occurs at a temperature within the range of 140–160 degrees centigrade.

8. A method for fabricating thick film resistor assemblies as claimed in claim 1, wherein:

the heating of said resistive material is done for a period within the range of eight to twelve minutes.

9. A method for fabricating thick film resistors as claimed in claim 1, wherein:

the heating of said conductors occurs for a period within the range of eight to twelve minutes.

* * * * *

UNITED STATES PATENT AND TRADEMARK OFFICE

CERTIFICATE OF CORRECTION

PATENT NO. : 4,894,258

DATED : January 16, 1990

INVENTOR(S) : Belanger, Jr.

It is certified that error appears in the above-identified patent and that said Letters Patent is hereby corrected as shown below:

The title page should be deleted to appear as per attached title page.

Signed and Sealed this

Twelfth Day of March, 1991

*Attest:*

HARRY F. MANBECK, JR.

*Attesting Officer*

*Commissioner of Patents and Trademarks*

United States Patent [19]

Belanger, Jr.

[11] Patent Number: 4,894,258

[45] Date of Patent: Jan. 16, 1990

[54] CHIP RESISTOR

[75] Inventor: Thomas D. Belanger, Jr., Clarendon Hills, Ill.

[73] Assignee: AG Communication Systems Corporation, Phoenix, Ariz.

[21] Appl. No.: 294,443

[22] Filed: Jan. 9, 1989

Related U.S. Application Data

[63] Continuation-in-part of Ser. No. 171,321, Mar. 21, 1988, abandoned.

[51] Int. Cl.[4] ..... B05D 5/12

[52] U.S. Cl. ..... 427/103; 156/246; 156/247; 156/250; 264/61; 428/901; 427/282

[58] Field of Search ..... 264/61, 212, 213, 102; 156/246, 247, 250; 428/43, 901; 427/103, 282

[56] References Cited

U.S. PATENT DOCUMENTS

| | | | |
|---|---|---|---|
| 4,349,496 | 9/1982 | Levinson | 264/61 |
| 4,366,198 | 12/1982 | Ramspacher, Jr. | 428/901 |
| 4,370,288 | 1/1983 | Rice, Jr. et al. | 264/61 |
| 4,734,233 | 3/1985 | Toda et al. | 264/61 |

*Primary Examiner*—Stanley Silverman

*Attorney, Agent, or Firm*—Robert J. Black; Gregory G. Hendricks

[57] ABSTRACT

Thick film resistors are fabricated for use in hybrid microcircuits by a sequence of steps beginning with the formation of a dielectric substrate on a carrier substrate. The dielectric layer is then baked to provide an appropriate rigidity after which a resistance element is deposited thereon as well as conductive terminals, the subsequent firing of both materials followed by heating of the entire assembly to a point where the adhesive characteristics of the dielectric layer are substantially reduced and the resultant film resistors become separated from the carrier substrate.

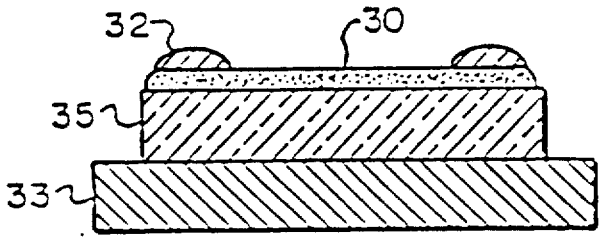

9 Claims, 1 Drawing Sheet